US007081022B2

(12) United States Patent
Fujii

(10) Patent No.: US 7,081,022 B2
(45) Date of Patent: Jul. 25, 2006

(54) ELECTRICAL APPARATUS HAVING CARD INSERTION SLOT AND COMBINED PRINTING APPARATUS HAVING CARD INSERTION SLOT

(75) Inventor: Toru Fujii, Daito (JP)

(73) Assignees: Funai Electric Co., Ltd., Osaka (JP); Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/212,121

(22) Filed: Aug. 25, 2005

(65) Prior Publication Data

US 2006/0046543 A1 Mar. 2, 2006

(30) Foreign Application Priority Data

Sep. 1, 2004 (JP) ..... 2004-254242

(51) Int. Cl.
*H01R 24/00* (2006.01)

(52) U.S. Cl. ..... 439/630; 439/377; 439/948

(58) Field of Classification Search ..... 439/630, 439/377, 64, 541.5, 131, 948
See application file for complete search history.

(56) References Cited

U.S. PATENT DOCUMENTS 6,264,506 B1 * 7/2001 Yasufuku et al. ..... 439/638

FOREIGN PATENT DOCUMENTS

JP 2000-029989 1/2000
JP 2000-305662 11/2000
JP 2003-076948 3/2003
JP 2004-031224 1/2004
JP 2004-103408 4/2004

OTHER PUBLICATIONS

Patent Abstracts of Japan, Publication No. 2004-103408, Publication Date: Apr. 2, 2004, 2 pages.
Patent Abstracts of Japan, Publication No. 2000-029989, Publication Date: Jan. 28, 2000, 2 page.
Patent Abstracts of Japan, Publication No. 2004-031224, Publication Date: Jan. 29, 2004, 2 pages.
Patent Abstracts of Japan, Publication No. 2003-076948, Publication Date: Mar. 14, 2003, 2 pages.
Patent Abstracts of Japan, Publication No. 2000-305662, Publication Date: Nov. 2, 2000, 2 pages.

* cited by examiner

*Primary Examiner*—Javaid H. Nasri
(74) *Attorney, Agent, or Firm*—Osha Liang LLP

(57) ABSTRACT

A combined printing apparatus includes a housing, an electric circuit substrate formed to extend from a top edge of a card insertion slot, a connector placed at a downside surface of the electric circuit substrate for connecting a memory card to an electric circuit, and a shielding plate formed under the connector. The connector is formed to extend in a direction approximately orthogonal to a longitudinal direction of the electric circuit substrate. The shielding plate includes a cut and bent up portion formed in a region opposite to the connector in the direction of extension of the connector. The cut and bent up portion is formed to prevent the memory card from being inserted between the shielding plate and the connector.

3 Claims, 3 Drawing Sheets

ELECTRICAL APPARATUS HAVING CARD INSERTION SLOT AND COMBINED PRINTING APPARATUS HAVING CARD INSERTION SLOT

BACKGROUND OF THE INVENTION

1. Field of the Invention

The present invention relates to an electrical apparatus and a combined printing apparatus.

2. Description of the Background Art

In recent years, a memory card has widely been used as a card-type recording medium capable of reading and writing electronic information. Since the memory card can record electronic information such as an image, it is mounted on an electrical apparatus such as a personal computer, a television receiver, and a printer. The electrical apparatus is provided with a memory card slot for connecting a memory card.

There are a plurality of types of memory cards including, for example, Compact Flash, SmartMedia, and a memory stick. Manufacturers of the electrical apparatus specify the types of memory cards to be used. In recent years, a memory card slot including a plurality of card connecting portions is formed in an electrical apparatus so that it can accommodate various types of memory cards.

FIG. 4 shows a perspective view of a combined printing apparatus, which is an example of an electrical apparatus having a memory card slot. The combined printing apparatus is a multifunctional printer that prints an image such as a photograph stored in a memory card. The combined printing apparatus in FIG. 4 functions as a scanner, a printing machine that performs printing in accordance with a signal coming from a personal computer or the like, and a printing machine that prints image data such as a photograph stored in a memory card.

An original presser plate 16, which is openable and closable, is placed at the top surface of the combined printing apparatus, and an image reading portion is formed under original presser plate 16. The image reading portion is placed under a glass plate 15 and formed such that an image can be read through glass plate 15 thereby. As shown by an arrow 44, original presser plate 16 is made openable and closable.

An operating portion 32 for operating the combined printing apparatus is formed at the top surface of the combined printing apparatus beside original presser plate 16. Operating portion 32 includes a liquid crystal display portion capable of providing an operational guide, an operation button and the like.

The combined printing apparatus includes a housing 1. A paper eject slot 18 is formed at the front of housing 1 so that a printed sheet of paper can be ejected therefrom. A paper tray 17 is formed to protrude from a lower part of paper eject slot 18 toward the front. A paper feed slot is formed on the rear side of the housing so that a sheet of paper to be printed is fed therefrom (not shown).

A memory card slot for connecting a memory card is formed at the upper front of housing 1. The memory card slot includes card insertion slots 31*a*, 31*b* for inserting a plurality of types of memory cards. The combined printing apparatus is provided with two card insertion slots.

FIG. 5 shows an enlarged view of a part A in FIG. 4. Card insertion slots 31*a*, 31*b* are formed to extend transversely when seen from the front. Card insertion slot 31*a* serves as an insertion slot for inserting a memory stick as a type of memory card, while card insertion slot 31*b* serves as an insertion slot for inserting Compact Flash as another type of memory card.

FIG. 6 shows a perspective cutaway view along a line XI—XI of FIG. 5. A connector 3*a* is formed in housing 1 to extend from a top edge of card insertion slot 31*a*. Connector 3*a* is formed to electrically connect to a memory stick inserted through card insertion slot 31*a*.

A plate-like member 4 is placed in housing 1 to extend from a bottom edge of card insertion slot 31*a*. Plate-like member 4 includes a concave portion 33, which is formed to fit the contour of a memory stick to be inserted. In other words, a memory stick is inserted into concave portion 33 to be electrically connected to connector 3*a*.

An electric circuit substrate 2 is placed under plate-like member 4. At the main surface of electric circuit substrate 2 on the downside, an electric component such as a capacitor is placed (not shown). At the main surface of electric circuit substrate 2 on the downside, a connector 3*b* is also formed to connect and fix Compact Flash. Connector 3*b* is shaped like a rod and is formed such that its longitudinal direction is approximately in parallel with the width direction of card insertion slot 31*b*. Connector 3*b* is formed such that it is visible through card insertion slot 31*b* when the combined printing apparatus is seen from the front.

A shielding plate 12 is formed under connector 3*b* leaving a space therebetween. Shielding plate 12 has a function of blocking an electromagnetic wave generated from the electric circuit substrate, and preventing damage to a circuit on the electric circuit substrate due to electrical discharge caused by static electricity. Since the electric component is placed at the main surface of electric circuit substrate 2 on the downside, shielding plate 12 is spaced apart from electric circuit substrate 2 to cover the electric component.

As such, an electrical apparatus such as a combined printing apparatus may be provided with a memory card slot so that a plurality of types of memory cards can be inserted therein.

Japanese Patent Laying-Open No. 2004-103408 discloses a slot connector including an accommodating space portion capable of detachably accommodating a memory card, and having a misinsertion preventive portion formed to prevent insertion of an incorrect memory card. The misinsertion preventive portion includes a pair of fastening members each made of a piece of an elastic member retracting from the accommodating space portion when a correct memory card is accommodated, and a slide bar provided in the accommodating space portion partway in the direction of insertion to engage the fastening members for preventing entry into a contact. It is disclosed that the slot connector can prevent an incorrect card from being inserted into the space portion for accommodating a card.

Japanese Patent Laying-Open No. 2000-029989 discloses a card storage device including a pair of guide rails for guiding a memory card, and a connector for electrically connecting to the memory card, and having a ceiling plate formed above the guide rails. It is disclosed that the card storage device can prevent a PC card from falling into the inside of the device in the case of misinsertion.

Referring to FIG. 6, the position of shielding plate 12 is determined by the height of the electric component placed at the main surface of electric circuit substrate 2, and a gap is formed between connector 3*b* and shielding plate 12. For example, if a memory stick to be inserted into the upper card insertion slot 31*a* is inserted into the lower card insertion slot 31*b*, the memory stick itself is bent and inevitably slips into the inside of the combined printing apparatus through the gap between connector 3*b* and shielding plate 12, as shown by an arrow 43.

Other types of memory cards may also have flexibility as the memory stick. Therefore, a memory card disadvantageously slips into the inside of the combined printing apparatus due to misinsertion and others. If a memory card slips into the inside of the combined printing apparatus, the combined printing apparatus must be disassembled because the memory card cannot be retrieved from the outside.

In the card storage device disclosed in Japanese Patent Laying-Open No. 2000-029989, a ceiling plate is formed to prevent a memory card from falling into the inside of the device. For the card storage device, however, it is necessary to form and attach a new member to prevent the card from falling into the inside of the device. In other words, productivity is inevitably degraded.

SUMMARY OF THE INVENTION

An object of the present invention is to provide an electrical apparatus and a combined printing apparatus that prevent a card from slipping into the inside thereof.

A combined printing apparatus according to the present invention includes: a housing including a card insertion slot for inserting a memory card; an electric circuit substrate formed to extend from a top edge of the card insertion slot toward an inside of the housing; a connector placed at a downside surface of the electric circuit substrate for connecting the memory card to an electric circuit; and a shielding plate formed under the connector such that a main surface thereof is approximately in parallel with a main surface of the electric circuit substrate. The connector is formed to extend in a direction approximately orthogonal to a longitudinal direction of the electric circuit substrate. The shielding plate includes a cut and bent up portion formed in a region opposite to the connector along a direction of extension of the connector. The cut and bent up portion is formed to prevent the memory card from being inserted between the shielding plate and the connector. By adopting the configuration, it is possible to provide a combined printing apparatus that prevents a problem caused by the memory card slipping into the inside thereof and left unretrieved.

An electrical apparatus according to the present invention includes: a housing including a card insertion slot for inserting a memory card; an electric circuit substrate to be electrically connected to the memory card; a connector formed at a surface of the electric circuit substrate for electrically connecting the memory card; and a shielding plate placed on the same side of the electric circuit substrate as the connector formed thereon, and formed such that a main surface thereof is approximately in parallel with a surface of the electric circuit substrate. The shielding plate includes a cut and bent up portion formed along a direction of extension of the connector. By adopting the configuration, it is possible to provide an electrical apparatus that prevents a problem caused by the memory card slipping into the inside thereof and left unretrieved.

In the invention above, the cut and bent up portion is preferably formed in a region opposite to the connector. By adopting the configuration, it is possible to more reliably prevent the memory card from slipping into the inside of the electrical apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Referring to FIGS. 1 to 4, a combined printing apparatus and an electrical apparatus according to the present invention will be described.

Figure 4:
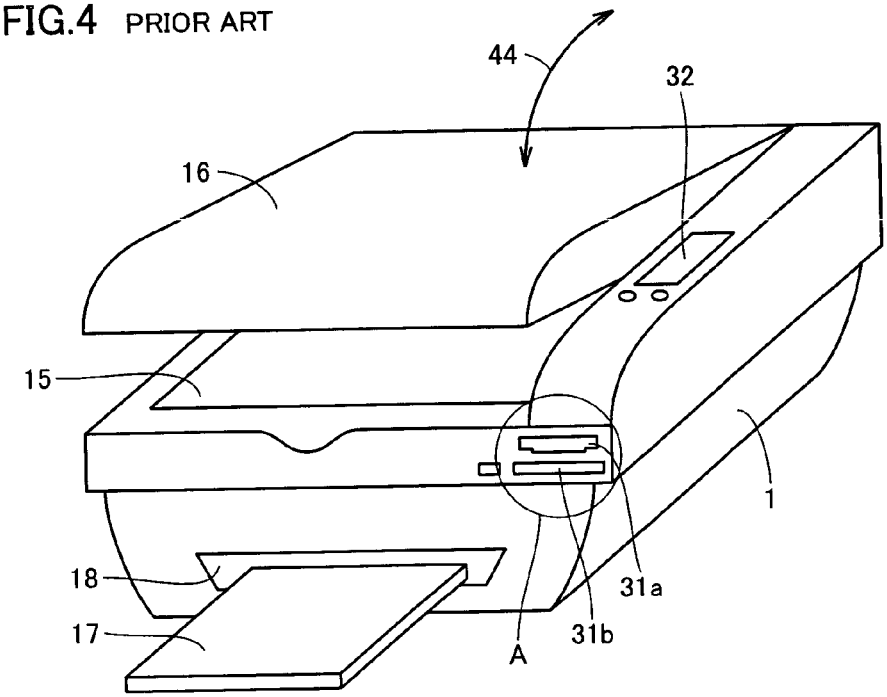
FIG.4 PRIOR ART
FIG. 4 is a perspective view of a combined printing apparatus.
Figure 5:
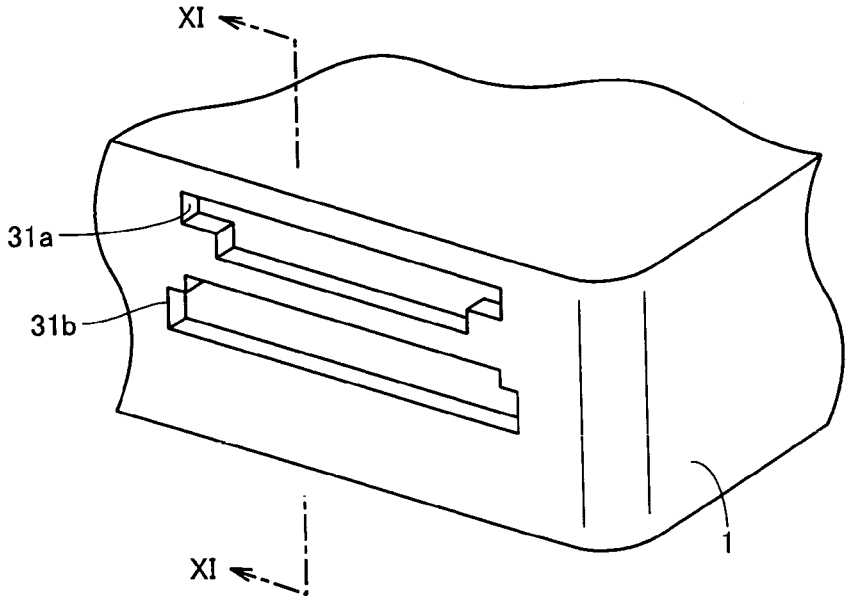
FIG.5 PRIOR ART
FIG. 5 is an enlarged view of a portion of the combined printing apparatus for inserting a memory card.
Figure 6:
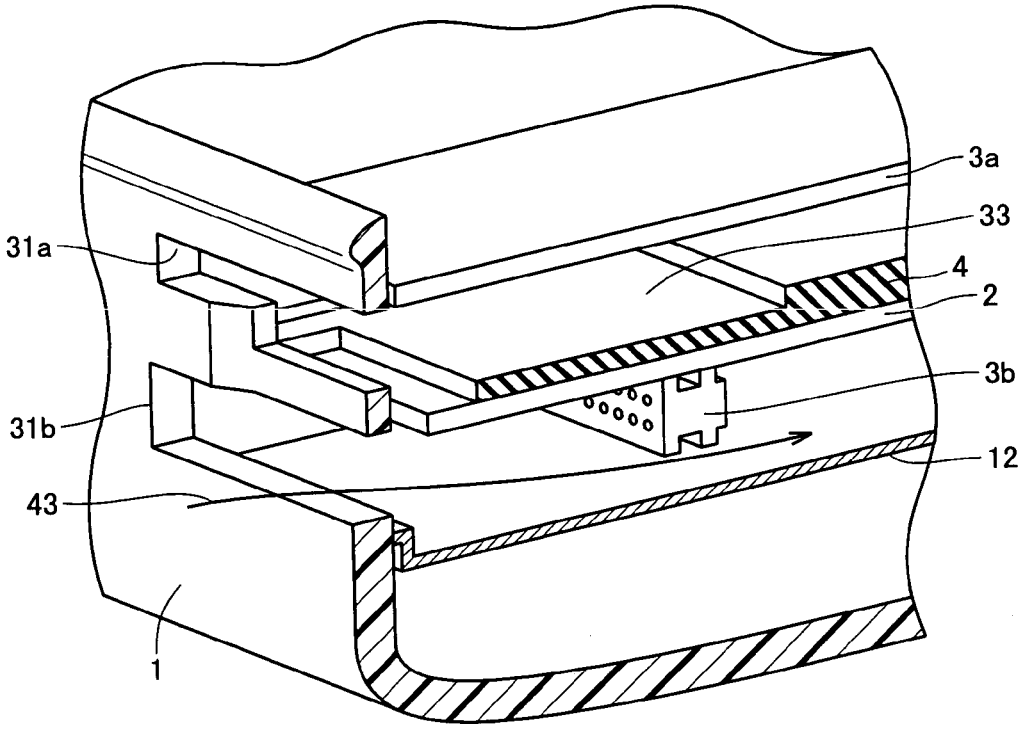
FIG.6 PRIOR ART
FIG. 6 is a perspective cutaway view of a conventional combined printing apparatus.

In the combined printing apparatus, as shown in FIG. 4, an original presser plate 16 is placed at the top, and a plurality of memory card slots are formed. Card insertion slots 31*a*, 31*b* are formed at the front of housing 1, as in the case of the conventional combined printing apparatus.

Figure 1:
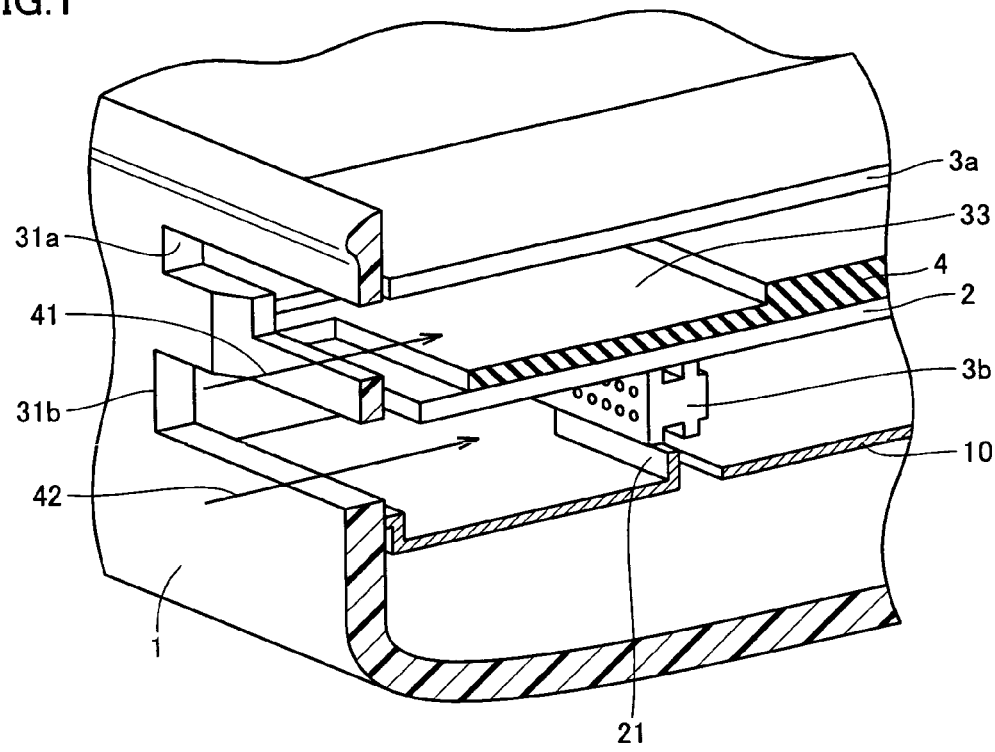
FIG. 1 is a perspective cutaway view of a first combined printing apparatus in an embodiment according to the present invention.

FIG. 1 is a perspective cutaway view showing a portion of a first combined printing apparatus according to the present embodiment, in which two card insertion slots are formed. Card insertion slot 31*a* serving as a first card insertion slot is formed to insert a memory stick as a first memory card, while card insertion slot 31*b* serving as a second card insertion slot is formed to insert Compact Flash as a second memory card.

Connector 3*a* is formed in housing 1 to extend from a top edge of card insertion slot 31*a*. Connector 3*a* is shaped like a plate and formed to extend toward the inside of housing 1. An electrode portion is formed at the downside surface of connector 3*a* for electrically connecting to a memory stick (not shown).

Plate-like member 4 is formed in housing 1 to extend from the bottom edge of card insertion slot 31*a*. Plate-like member 4 is shaped like a plate and formed to extend toward the inside of housing 1. Concave portion 33 is formed in plate-like member 4 in the proximity of card insertion slot 31*a*. Concave portion 33 is formed to fit the contour of a memory stick.

Electric circuit substrate 2 is formed under plate-like member 4 between card insertion slot 31*a* and card insertion slot 31*b*. An electric component such as a capacitor or a resistor is placed at a main surface of electric circuit substrate 2 on the underside.

At the main surface of electric circuit substrate 2 on the underside, connector 3*b* is formed for electrically connecting to Compact Flash inserted through card insertion slot 31*b*. Connector 3*b* is shaped like a prism, and placed such that its longitudinal direction is approximately in parallel with a plane on which card insertion slot 31*b* is formed. Connector 3*b* has an electrode portion formed on a side opposite to card insertion slot 31*b* for electrically connecting to Compact Flash. Connector 3*b* is formed such that it is visible when card insertion slot 31*b* is seen from the front.

Each of connectors 3*a*, 3*b* is formed to connect a memory card inserted into corresponding memory card slot to an electric circuit placed in housing 1.

A shielding plate 10 is placed under connector 3*b*. Shielding plate 10 is shaped like a flat plate, and spaced apart from the surface of electric circuit substrate 2. Shielding plate 10 is formed such that its main surface is approximately in parallel with a main surface of the electric circuit substrate. Shielding plate 10 is placed on the same side of electric circuit substrate 2 as connector 3*b* formed thereon.

Shielding plate 10 is formed of a metal material to prevent noise emission to the outside from an electric circuit formed on electric circuit substrate 2, and electric discharge caused by static electricity toward electric circuit substrate 2. Alternatively, the shielding plate may be an insulating plate having a surface coated with a conductive film. For example, a plate-like member formed of resin and coated with a plating film may be used.

In the combined printing apparatus according to the present invention, shielding plate 10 includes a cut and bent up portion 21. Cut and bent up portion 21 is formed to be a wall extending toward the side on which connector 3*b* is formed. Cut and bent up portion 21 is formed such that a part of shielding plate 10 is slit and bent up. Cut and bent up portion 21 is formed such that its main surface is approximately vertical to a main surface of shielding plate 10.

In a first combined printing apparatus according to the present embodiment, cut and bent up portion 21 is formed at the main surface of shielding plate 10 in a region opposite to connector 3*b*. Cut and bent up portion 21 is formed along a direction of extension of connector 3*b*. Cut and bent up portion 21 is formed to have a rectangular shape at the front such that a bottom edge of connector 3*b* and a top edge of cut and bent up portion 21 are approximately in parallel with each other.

Figure 2:
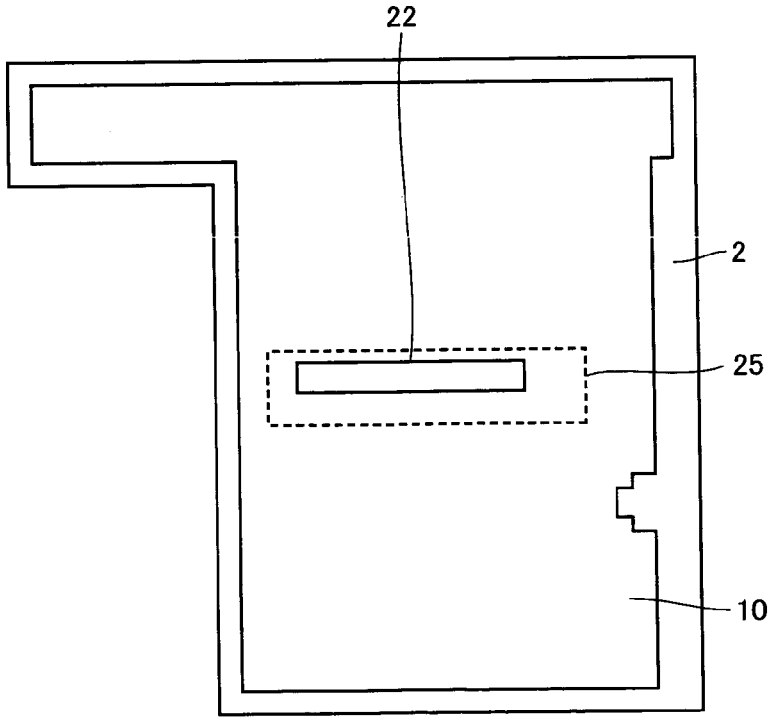
FIG. 2 is a bottom view of a shielding plate and an electric circuit substrate of the first combined printing apparatus in the embodiment according to the present invention.

FIG. 2 is a bottom view of electric circuit substrate 2 and shielding plate 10 when seen from the side on which shielding plate 10 is placed. Since the cut and bent up portion is formed to extend toward electric circuit substrate 2, an opening 22 is formed in shielding plate 10. Opening 22 has a shape approximately similar to that of cut and bent up portion 21, and is formed to have a rectangular shape in the first combined printing apparatus. In the first combined printing apparatus, opening 22 is formed in a projected region 25 onto which connector 3*b* throws shade when projected toward shielding plate 10.

Figure 3:
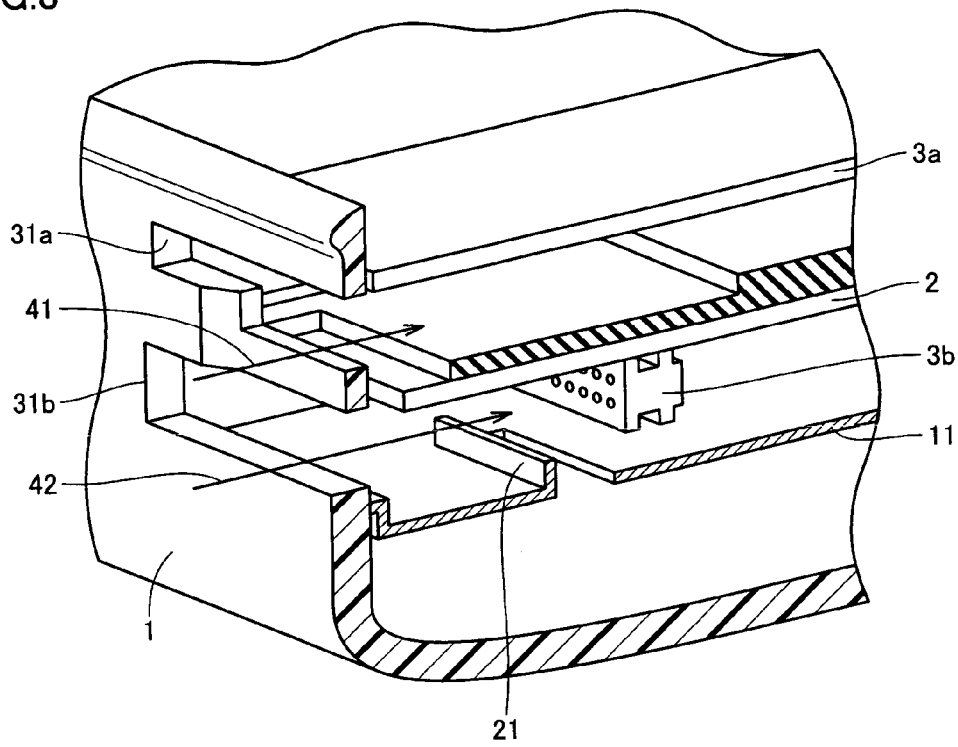
FIG. 3 is a perspective cutaway view of a second combined printing apparatus in an embodiment according to the present invention.

FIG. 3 is a perspective cutaway view showing a second combined printing apparatus according to the present embodiment. The second combined printing apparatus includes a shielding plate 11 having cut and bent up portion 21. Cut and bent up portion 21 is formed on shielding plate 11 between a region opposite to connector 3*b* and card insertion slot 31*b*. In other words, when seen from the front, cut and bent up portion 21 is placed more forward than connector 3*b*. Cut and bent up portion 21 is formed to extend toward the side on which connector 3*b* is formed, namely, the upside. Other configurations are similar to those of the first combined printing apparatus.

Referring to FIG. 1, a memory stick as a first memory card is inserted through card insertion slot 31*a* as shown by an arrow 41. The inserted memory stick fits the contour of concave portion 33, and is electrically connected and fixed at the place where it abuts against a step portion on the backside of concave portion 33. Compact Flash as a second memory card is inserted through card insertion slot 31*b* as shown by an arrow 42. Compact Flash is electrically connected and fixed by fitting connector 3*b*.

Here, if a memory card thinner and more flexible than Compact Flash is inserted into card insertion slot 31*b*, it abuts against connector 3*b* or cut and bent up portion 21. Therefore, it is possible to prevent the memory card from slipping into the inside of the combined printing apparatus between shielding plate 10 and connector 3*b*.

In the present invention, a shielding plate is processed without adding any new member, which makes it possible to prevent a memory card from slipping into the inside of the combined printing apparatus. In the present invention, only a part of shielding plate is required to be processed, which can suppress degradation in productivity.

In the first combined printing apparatus according to the present embodiment, cut and bent up portion 21 is formed on shielding plate 10 in a region opposite to connector 3*b*. By adopting the configuration, cut and bent up portion 21 can close the gap between shielding plate 10 and connector 3*b*, which makes it possible to more reliably prevent a memory card from slipping into the inside of the combined printing apparatus.

The length and shape of the cut and bent up portion are not particularly limited as long as the cut and bent up portion is formed to prevent the memory card, when inserted into the memory card slot, from slipping into the inside of the combined printing apparatus. Although a single cut and bent up portion 21 is formed in the present embodiment, the number thereof is not particularly limited thereto. A plurality of cut and bent up portions 21 may be formed.

As in the second combined printing apparatus shown in FIG. 3, cut and bent up portion 21 may be formed on shielding plate 11 outside the region opposite to connector 3*b*. In FIG. 3, the distance between connector 3*b* and cut and bent up portion 21 is small, which can prevent a memory card such as memory stick from bending and slipping into the inside of the combined printing apparatus between connector 3*b* and shielding plate 11.

In the present embodiment, the connector is formed under the electric circuit substrate, and the shielding plate is formed under the connector. However, their position is not particularly limited thereto. The connector may be placed above the electric circuit substrate, and the shielding plate may be formed above the connector. In this case, the cut and bent up portion is formed toward the bottom.

Although a combined printing apparatus is described as an example of an electrical apparatus in the present embodiment, it is not particularly limited thereto. The present invention may be applied to any electrical apparatus having a function of electrically connecting to an inserted memory card. For example, the present invention may be applied to a personal computer, a television receiver, a digital camera or the like. The present invention may be applied to, for example, a television receiver, a housing of which is provided with a card insertion slot to form the memory card slot according to the present embodiment.

According to the present invention, it is possible to provide an electrical apparatus and a combined printing apparatus that prevent a problem caused by a memory card slipping into the inside thereof and left unretrieved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A combined printing apparatus, comprising:

a housing including a card insertion slot for inserting a memory card;

an electric circuit substrate formed to extend from a top edge of said card insertion slot toward an inside of said housing;

a connector placed at a downside surface of said electric circuit substrate for connecting said memory card to an electric circuit; and a shielding plate formed under said connector such that a main surface thereof is approximately in parallel with a main surface of said electric circuit substrate, wherein said connector is formed to extend in a direction approximately orthogonal to a longitudinal direction of said electric circuit substrate, said shielding plate includes a cut and bent up portion formed in a region opposite to said connector along a direction of extension of said connector, and said cut and bent up portion is formed to prevent said memory card from being inserted between said shielding plate and said connector.

2. An electrical apparatus, comprising:

a housing including a card insertion slot for inserting a memory card;

an electric circuit substrate to be electrically connected to said memory card;

a connector formed at a surface of said electric circuit substrate for electrically connecting said memory card; and a shielding plate placed on the same side of said electric circuit substrate as said connector formed thereon, and formed such that a main surface thereof is approximately in parallel with a surface of said electric circuit substrate, wherein said shielding plate includes a cut and bent up portion formed along a direction of extension of said connector.

3. The electrical apparatus according to claim 2, wherein said cut and bent up portion is formed in a region opposite to said connector.

* * * * *